US008770951B2

(12) United States Patent
Ishibashi

(10) Patent No.: US 8,770,951 B2
(45) Date of Patent: Jul. 8, 2014

(54) AIR PUMP

(75) Inventor: Shigemitsu Ishibashi, Kawasaki (JP)

(73) Assignee: Nitto Kohki Co., Ltd., Tokyo (JP)

( * ) Notice: Subject to any disclaimer, the term of this patent is extended or adjusted under 35 U.S.C. 154(b) by 33 days.

(21) Appl. No.: 13/190,950

(22) Filed: Jul. 26, 2011

(65) Prior Publication Data

US 2011/0280751 A1 Nov. 17, 2011

Related U.S. Application Data

(63) Continuation of application No. PCT/JP2010/051235, filed on Jan. 29, 2010.

(30) Foreign Application Priority Data

Jan. 30, 2009 (JP) ..... 2009-019866

(51) Int. Cl.
*F04B 35/04* (2006.01)
*F04B 39/12* (2006.01)

(52) U.S. Cl.
CPC ..... *F04B 35/045* (2013.01); *F04B 39/127* (2013.01)
USPC ..... 417/418; 417/417; 417/416; 417/415

(58) Field of Classification Search
CPC ..... F04B 39/127; F04B 35/045
USPC ..... 417/415, 416, 417, 418
See application file for complete search history.

(56) References Cited

U.S. PATENT DOCUMENTS 3,931,554 A * 1/1976 Spentzas ..... 318/122
4,395,649 A * 7/1983 Thome et al. ..... 310/15
4,968,225 A * 11/1990 Hashimoto et al. ..... 417/413.1
5,011,379 A * 4/1991 Hashimoto ..... 417/360
5,104,298 A * 4/1992 Takahashi et al. ..... 417/415
6,382,935 B1 * 5/2002 Mikiya et al. ..... 417/413.1
2011/0274571 A1 * 11/2011 Ishibashi et al. ..... 417/417

FOREIGN PATENT DOCUMENTS

JP 2000-045943 A 2/2000
JP 3472488 B2 12/2003
JP 3616988 B2 2/2005
JP 2008-231936 A 10/2008

OTHER PUBLICATIONS

International Search Report for International Application No. PCT/JP2010/051235, dated Apr. 20, 2010. 1 page.

* cited by examiner

*Primary Examiner* — Charles Freay
*Assistant Examiner* — Christopher Bobish
(74) *Attorney, Agent, or Firm* — Brinks Gilson & Lione

(57) ABSTRACT

An air pump structured to facilitate the installation of a pair of pistons includes a casing (17) having a pair of cylinder chambers (14) slidably accommodating a pair of pistons (16), respectively, and a drive chamber accommodating electromagnets between the pair of cylinder chambers. The pump casing has mutually opposing side walls and a cylindrical peripheral wall defining the drive chamber. The side walls have circular cylindrical inner peripheral surfaces (28-1) of the cylinders defined therein, respectively. A piston assembly having the pistons connected to the opposite ends of an armature (34) is inserted into the pump casing through one of the cylindrical inner peripheral surfaces and installed therein. The peripheral wall has an electromagnet-loading opening (26-2) through which electromagnet pedestal members (26-7) and the electromagnets are inserted into the casing and secured therein.

5 Claims, 9 Drawing Sheets

AIR PUMP

RELATED APPLICATIONS

This application is a continuation of PCT/JP2010/051235 filed on Jan. 29, 2010, which claims priority to Japanese Application No. 2009-019866 filed on Jan. 30, 2009. The entire contents of these applications are incorporated herein by reference.

BACKGROUND OF THE INVENTION

1. Field of the Invention

The present invention relates to air pumps and, more particularly, to an electromagnetically-driven reciprocating air pump.

2. Description of the Related Art

An electromagnetically-driven reciprocating air pump usually has a piston assembly of a pair of pistons and an armature connecting the pair of pistons in the state that the pair of pistons are axially aligned with each other. The air pump further has electromagnets installed at the opposite sides, respectively of the armature. When an alternating electric current is applied thereto, the electromagnets generate an alternating magnetic field to reciprocate the armature in the axial direction of the pistons. Further, the air pump has a pump casing having a pair of cylinder chambers slidably accommodating the pair of pistons, respectively, and a drive chamber accommodating the armature extending between the cylinder chambers and accommodating the electromagnets.

In the above-described pump casing, electromagnet pedestals are formed to project from the inner wall surface of the casing into the drive chamber to set the electromagnets at respective proper positions with respect to permanent magnets attached to the armature transversely extending in the drive chamber. The electromagnets are secured to the electromagnet pedestals. Accordingly, the electromagnet pedestals will interfere with the installation of the pair of pistons if the pistons are connected together into a piston assembly by the armature, as stated above, and the piston assembly is inserted into the casing through one cylinder chamber of the casing so as to extend as far as the other cylinder chamber. Therefore, with conventional air pumps of this type, the pistons are inserted into the cylinder chambers from the left and right sides of the casing, respectively, and after having been installed in the cylinder chamber, the pistons are connected to each other by the armature.

However, such a piston installation operation is complicated and time-consuming. Therefore, there has been a demand for the pistons to be capable of being installed more easily.

The present invention provides an air pump capable of meeting the above-described demand.

SUMMARY OF THE INVENTION

The present invention provides an air pump including a piston assembly of a pair of pistons and an armature disposed between the pair of pistons to connect the pistons in the state that the pair of pistons are aligned with each other in the axial direction of the pistons. The air pump further includes a pair of electromagnets provided at the opposite sides, respectively, of the armature in a direction perpendicular to the axial direction. When an alternating electric current is applied thereto, the electromagnets generate an alternating magnetic field traversing the armature to reciprocate the armature in the axial direction of the pistons. Further, the air pump includes a pump casing including a pair of cylinder chambers slidably accommodating the pair of pistons, respectively, and a drive chamber accommodating the armature extending between the pair of cylinder chambers and the electromagnets. The pump casing has a casing body having side walls opposing each other in the axial direction. The side walls have circular cylindrical inner peripheral surfaces extending through the side walls, respectively, to define the cylinder chambers. The cylindrical inner peripheral surfaces are slidable relative to the associated pistons. The casing body further has a cylindrical peripheral wall extending between the mutually opposing side walls to define the drive chamber. The casing body has an electromagnet-loading opening extending through the peripheral wall from the drive chamber to the outside. The piston assembly is inserted into the casing body in the axial direction through the cylindrical inner peripheral surface of one of the side walls so that the pair of pistons are installed in the associated cylindrical inner peripheral surfaces. The pump casing further has at least one electromagnet pedestal member for positioning the pair of electromagnets at the opposite sides of the armature. The electromagnet pedestal member is inserted into the drive chamber through the electromagnet-loading opening and engaged with the inner peripheral surface of the peripheral wall. The electromagnet pedestal member engages with the associated electromagnets inserted from the electromagnet-loading opening to position the electromagnets relative to the armature. Further, the pump casing has head covers attached to the casing body, after the piston assembly has been loaded thereinto, from the left and right sides, respectively, of the casing body. The head covers define the cylinder chambers, together with the cylindrical inner wall surfaces.

In this air pump, the electromagnet pedestal is prepared as a member separate from the pump body. Therefore, the piston assembly can be inserted from one side of the pump body as one unit and installed therein.

Specifically, the arrangement may be as follows. The casing body has through-holes extending through the side walls, respectively, and has cylindrical cylinder members fitted and secured to the through-holes, respectively. The cylinder members define the cylindrical inner peripheral surfaces.

Further, the at least one electromagnet pedestal member may comprise a pair of electromagnet pedestal members corresponding to the pair of electromagnets.

One embodiment of an air pump according to the present invention will be explained below in detail with reference to the accompanying drawings.

DETAILED DESCRIPTION OF THE PREFERRED EMBODIMENTS

Figure 1:
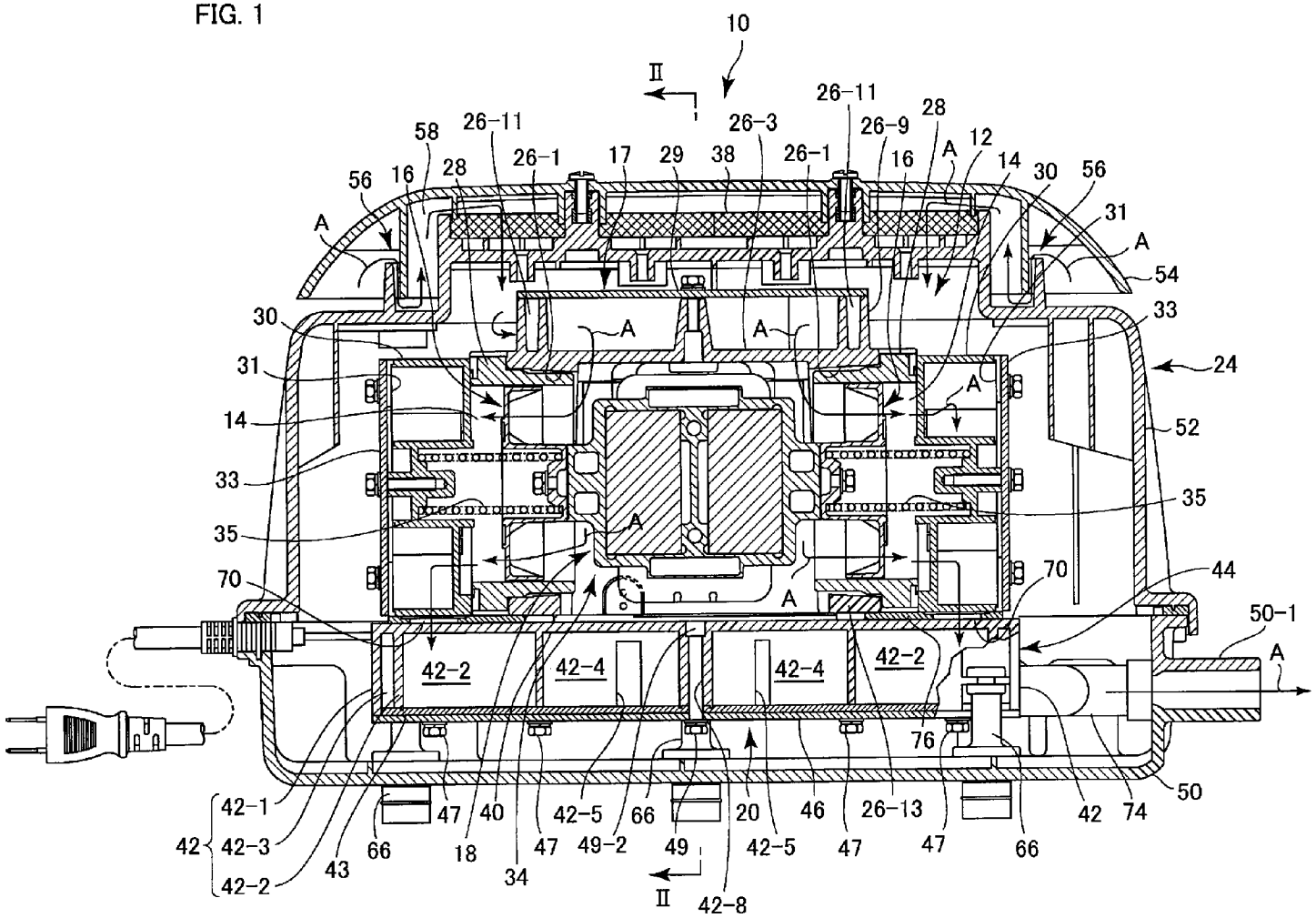
FIG. 1 is a vertical sectional view of an air pump according to the present invention.

As illustrated in the figures, an air pump 10 according to the present invention has a pump unit 12 for sucking in and compressing air from the surroundings and an air tank 20 for temporarily storing the compressed air from the pump unit 12 to suppress pulsation caused by reciprocating motion of pistons 16 of the pump unit 12 before discharging the compressed air. The air pump 10 further has a housing 24 accommodating the pump unit 12 and the air tank 20.

First, these constituent elements and the overall structure will be outlined below.

First, the pump unit 12 has a casing 17 having a pair of cylinder chambers 14 disposed in bilateral symmetry as seen in FIG. 1 to accommodate the pistons 16, respectively. The pump unit 12 further has an electromagnetic drive unit 18 reciprocating the two pistons 16 in the state of the two pistons being connected to each other. Specifically, the casing 17 has, as shown in FIGS. 2 to 5, a casing body 26 having a box shape as a whole and defining a drive chamber accommodating the electromagnetic drive unit 18, and a pair of cylinder members 28 fitted into through-holes 26-1 formed in left and right (as seen in FIG. 1) side walls 26-13, respectively, of the casing body 26. Further, the casing 17 has head covers 30 installed so as to sandwich the casing body 26 from the left and right sides of the latter, as seen in FIG. 1, to define the cylinder chambers 14 together with the cylinder members 28, and end wall members 33 abutted and secured to the respective end surfaces of the head covers 30 through seal members 31.

Figure 2:
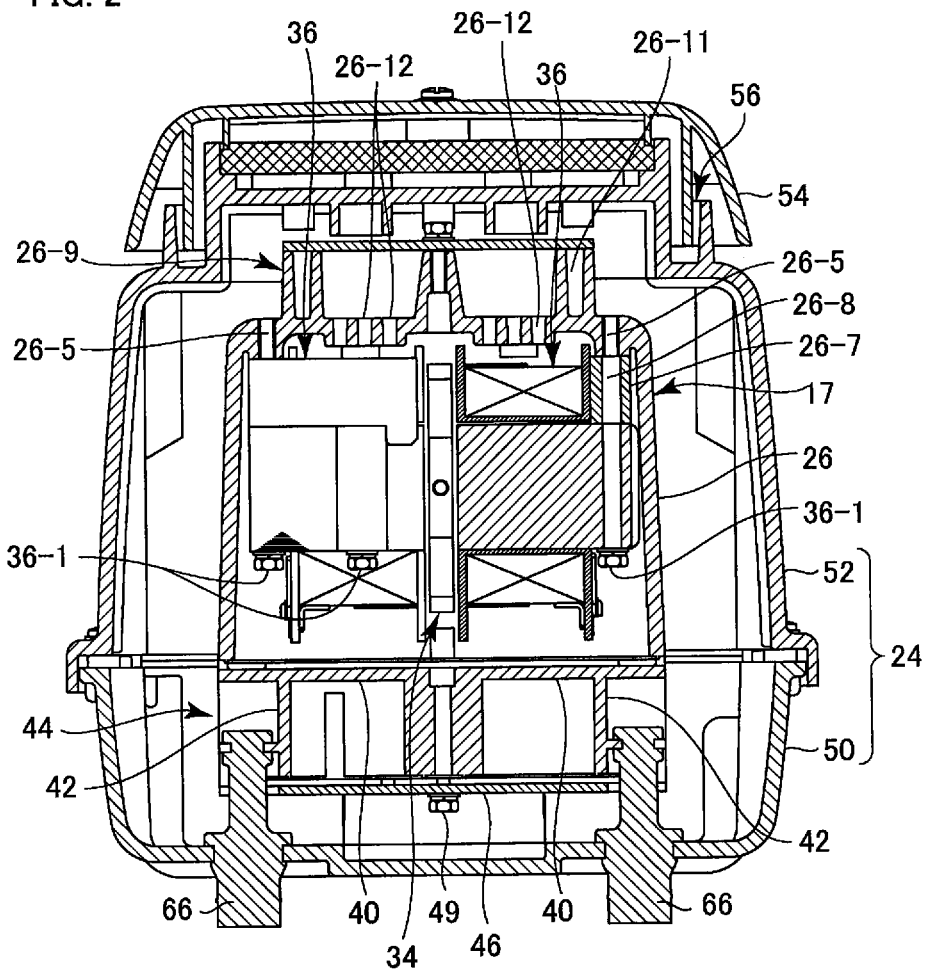
FIG. 2 is a sectional view taken along the line II-II in FIG. 1.
Figure 3:
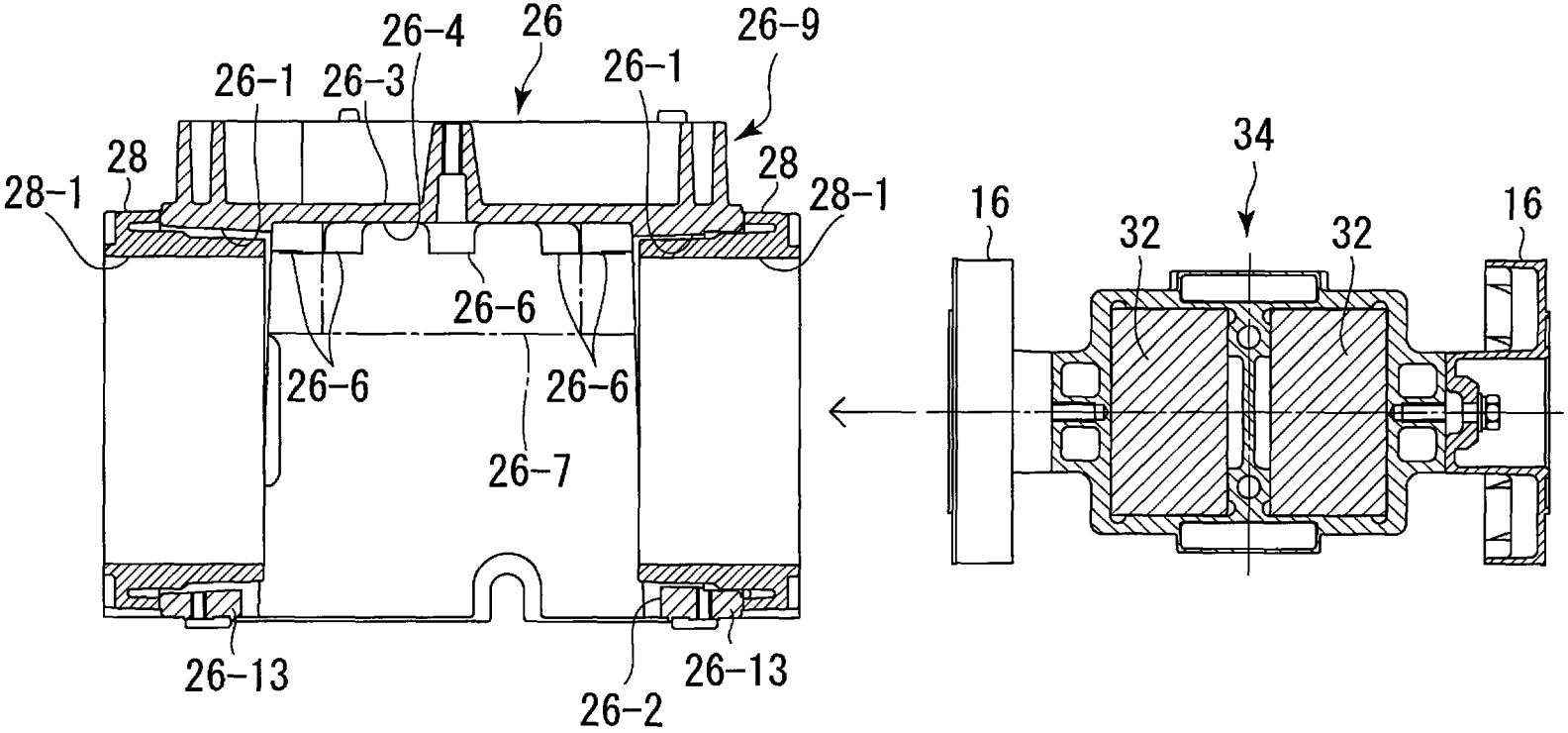
FIG. 3 is a sectional front view showing an assembly of a casing body constituting a casing of a pump unit and cylinder bodies and an assembly of pistons and an armature, in which only one of the pistons is not cut by the section line.
Figure 4:
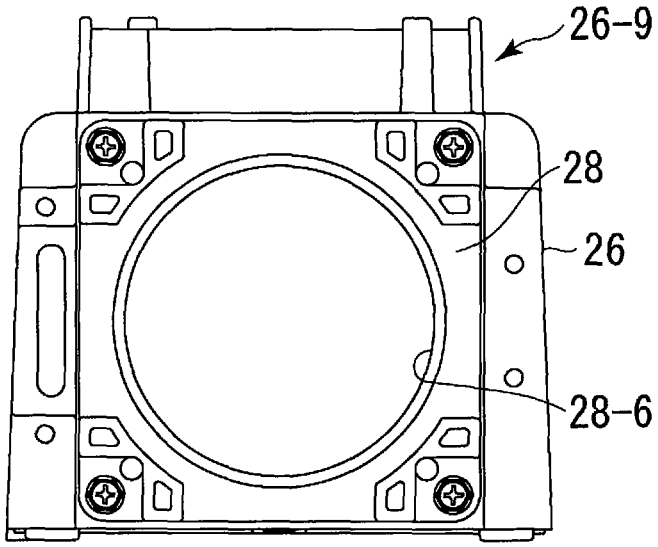
FIG. 4 is a side view of the assembly of the casing body and the cylinder bodies.

The electromagnetic drive unit 18 has an armature 34 connecting the pair of pistons 16 to each other and having plate-shaped permanent magnets 32 disposed in bilateral symmetry as seen in FIGS. 1 and 3, and electromagnets 36 provided at the opposite sides, respectively, of the armature 34 as seen in FIG. 2. The electromagnets 36 act on the permanent magnets 32, thereby causing the armature 34 to reciprocate in the lateral direction as seen in FIG. 1. Coil springs 35 are provided at the left and right sides, respectively, of the armature 34 as seen in FIG. 1 to hold the armature 34 in the center of the pump unit 12. When an alternating electric current is applied to the electromagnets 36, an alternating magnetic field is generated to reciprocate the armature 34 equipped with the permanent magnets 32, together with the pistons 16 at the opposite ends of the armature 34. Consequently, the surrounding air is sucked into the pump unit 12 through a filter 38 installed in the top of the housing 24. The sucked air is compressed in the cylinder chambers 14 and supplied into the air tank 20. The air flows as shown by the arrows A, although the details of the air flow path are not shown. The electromagnetic drive unit 18 is a technique known to those skilled in the art as disclosed, for example, in Japanese Patent Application Publication No. 2007-16761. Therefore, a detailed explanation of the structure of the electromagnetic drive unit 18 is omitted herein.

The air tank 20 has a resinous tank body 44 having a top wall 40 of a rectangular shape in plan view, on which the pump unit 12 is placed. The tank body 44 further has a peripheral wall 42 extending downward from the top wall 40. Thus, the tank body 44 has a downward facing opening. The air tank 20 further has a metallic bottom wall member 46 installed to close the opening of the tank body 44. The bottom wall member 46 has a plurality of bolts 47 passed through a peripheral edge portion thereof. The bolts 47 are thread-engaged with the metallic casing 17 of the pump unit and tightened to clamp the resinous tank body 44 between the metallic bottom wall member 46 and the casing 17.

Specifically, the housing 24, which accommodates the pump unit 12 and the air tank 20, has a flat-bottomed pan-shaped bottom part 50, a housing body 52 installed on the bottom part 50, and a cover 54 attached to the top of the housing body 52. An air intake passage 58 with a rainwater trap portion 56 is provided between the cover 54 and the housing body 52. Air introduced into the housing 24 through the rainwater trap portion 56 passes into the inside of the housing through the filter 38 provided in the top of the housing body 52. The bottom part 50 of the housing 24 supports the air tank 20 through support studs 66 made of a damper rubber.

The above is the outline of the air pump according to the present invention. The following is an explanation of the details of the air pump.

Figure 5:
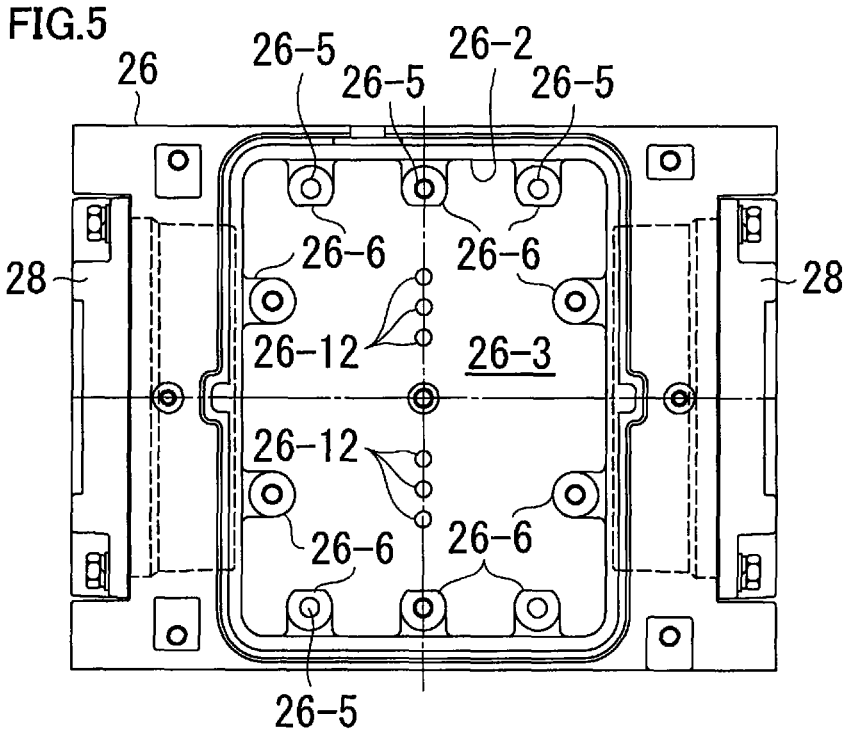
FIG. 5 is a bottom view of the assembly of the casing body and the cylinder bodies.

FIG. 3 shows an assembly of the casing body 26 and a pair of cylinder members 28 fitted into the left and right (as seen in the figure) through-holes 26-1, respectively, of the casing body 26 to constitute the casing 17, and also shows an assembly of the pistons 16 and the armature 34, which is to be loaded into the first-mentioned assembly. The casing body 26 has an electromagnet-loading opening 26-2 in the center of the bottom wall thereof. As shown in FIG. 5, the opening 26-2 is rectangular in shape as seen from below. Regarding the pair of cylinder members 28, one cylinder member 28 is inserted into one through-hole 26-1 and bolted, and the other cylinder member 28 is inserted into the other through-hole 26-1 and bolted in a state where a circular cylindrical inner peripheral surface 28-1 of the other cylinder member 28, which receives the associated piston 16, is axially aligned with the inner peripheral surface 28-1 of the one cylinder member 28 (see FIGS. 4 and 5). The assembly of the armature 34 and the pistons 16 can, as shown in FIG. 3, be inserted into the casing body 26 from one end side thereof through one cylinder member 28.

Figure 6:
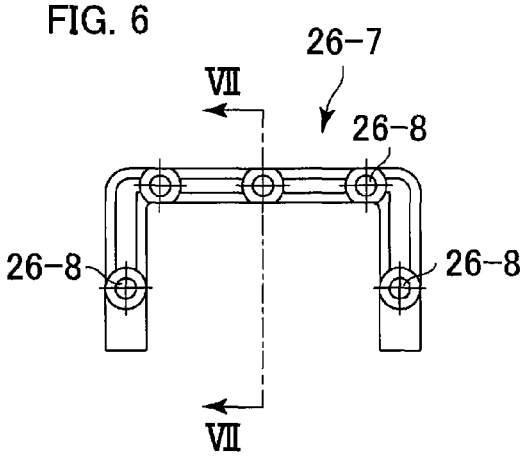
FIG. 6 is a plan view of an electromagnet pedestal member.
Figure 7:
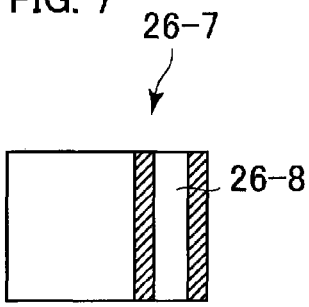
FIG. 7 is a sectional view taken along the line VII-VII in FIG. 6.
Figure 8:
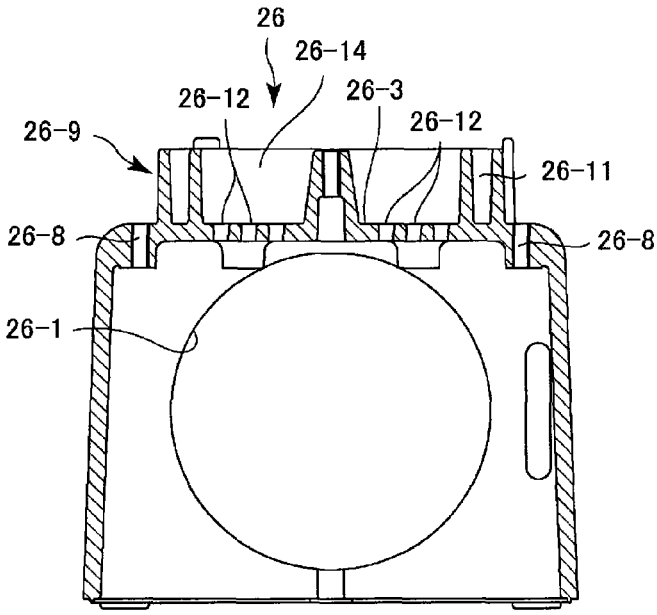
FIG. 8 is a sectional view taken along the line VIII-VIII in FIG. 9.

As shown in FIGS. 5 and 3, the casing body 26 has a top wall 26-3 with an inner surface 26-4 corresponding to the electromagnet-loading opening 26-2 of the bottom wall thereof. The inner surface 26-4 of the top wall 26-3 is provided with mutually spaced internal thread portions 26-6 having threaded holes 26-5 vertically extending through the top wall 26-3. The internal thread portions 26-6 are provided corresponding to the peripheral edge of the bottom opening 26-2. The internal thread portions 26-6 are provided symmetrically about a horizontal line as seen in FIG. 5. As shown in FIGS. 6 and 7, a U-shaped electromagnet pedestal member 26-7 has holes 26-8 provided corresponding to the threaded holes 26-5. The electromagnet pedestal member 26-7 is provided for each of the upper and lower groups of internal thread portions 26-6 and abutted against the associated internal thread portions 26-6. As shown in FIG. 2, bolts 36-1 are inserted through the electromagnets 36 from below and further through the holes 26-8 and thread-engaged with the threaded holes 26-5 of the internal thread portions 26-6, thereby setting the electromagnets 36 at respective proper positions with respect to the permanent magnets 32 of the armature 34.

Figure 9:
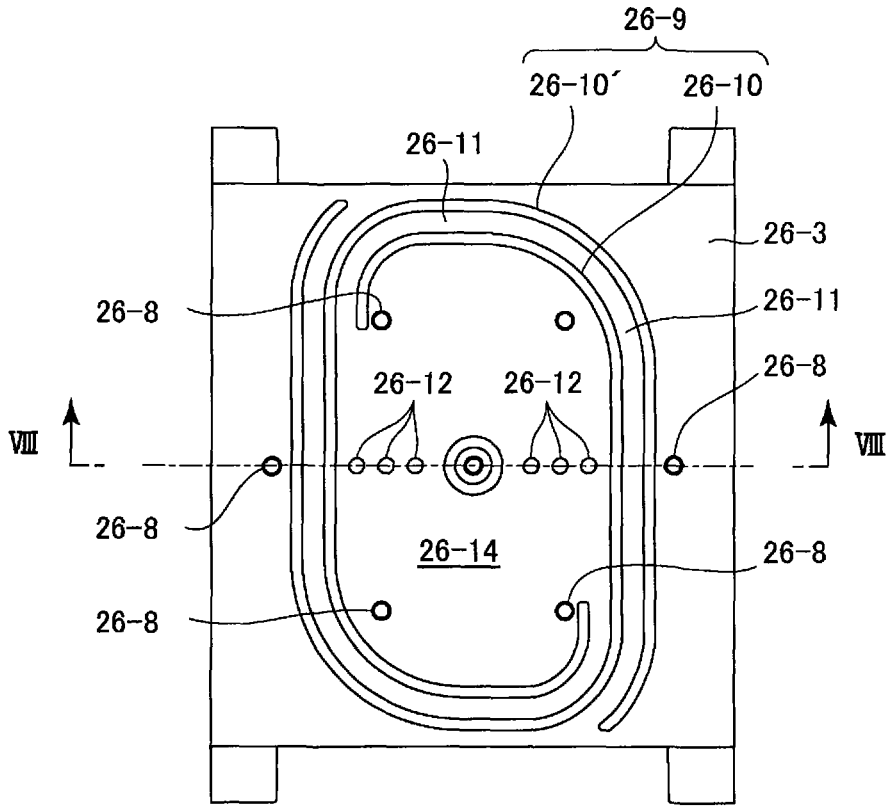
FIG. 9 is a plan view of the casing body.

The casing body 26 has a noise reduction wall 26-9 standing on the upper surface of the top wall 26-3. Specifically, the noise reduction wall 26-9 comprises, as shown in FIG. 9, a pair of parallel extending loop-shaped or annular walls 26-10 and 26-10'. One wall 26-10 extends counterclockwise from the upper right of the figure through about 360° such that the terminating end of the wall 26-10 is inward of the starting end thereof. The other wall 26-10' extends clockwise from a lower right position in parallel to and inward of the one wall 26-10, passes inward of the starting end of the one wall 26-10, and further extends parallel to the one wall 26-10. The other wall 26-10' extends through about 360° in total. Between the walls 26-10 and 26-10' is formed an air intake passage 26-11 also functioning as a noise reduction passage. A plate-shaped lid member 29 is placed on and bolted to the top of the noise reduction wall 26-9. Thus, a noise reduction chamber 26-14 is defined by the outer peripheral surface of the housing, the noise reduction wall 26-9 and the lid member 29. Air introduced into the housing body 52 through the filter 38 provided in the top of the housing body 52 enters the noise reduction chamber 26-14 through the noise reduction passage 26-11 and is introduced into the casing body 26 through holes 26-12 (FIGS. 2 and 5) provided to extend through the top wall 26-3. The inner surface defining the holes 26-12 of the top wall 26-3 extends downward to lengthen the holes 26-12. The noise reduction wall 26-9, the noise reduction chamber 26-14, the holes 26-12 and so forth are configured so that noise generated by the reciprocating motion of the armature 34 is reduced and suppressed from being transmitted to the outside through air-introducing passages such as the holes 26-12, the noise reduction chamber 26-14 and the noise reduction passage 26-11.

Figure 10:
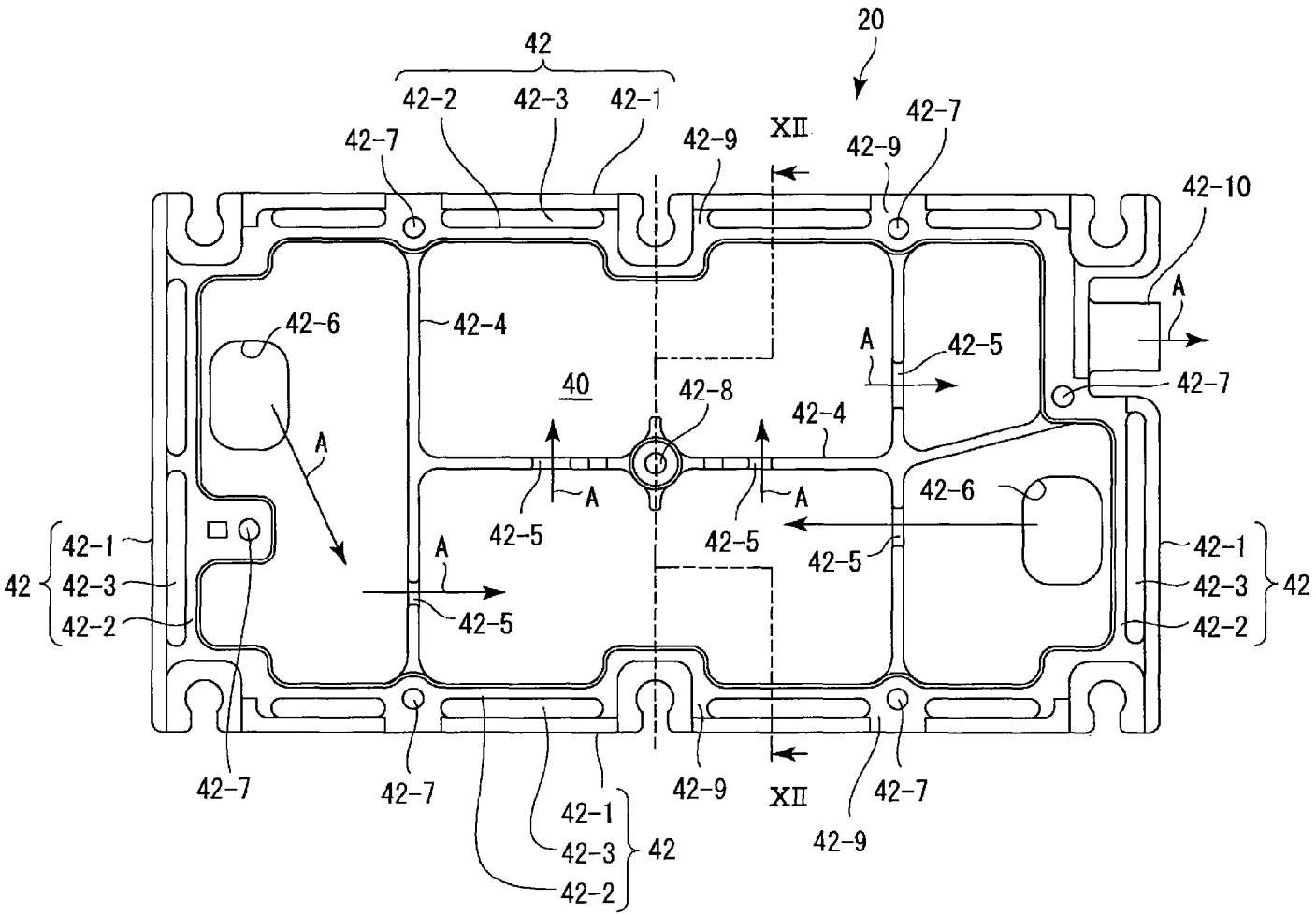
FIG. 10 is a bottom view of a tank body.
Figure 11:
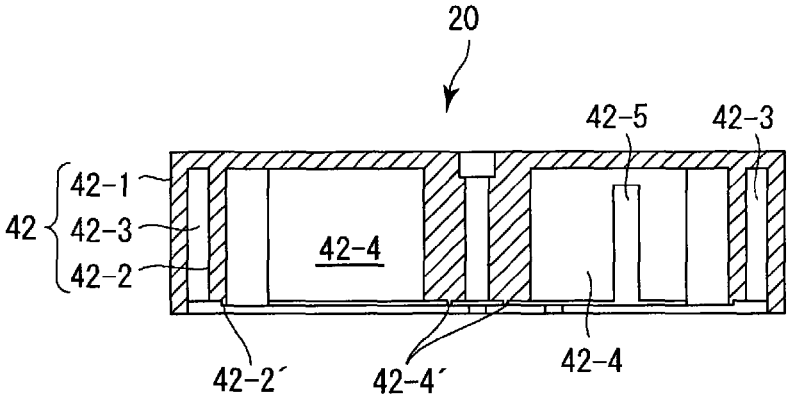
FIG. 11 is a sectional view taken along the line XI-XI in FIG. 10.
Figure 13:
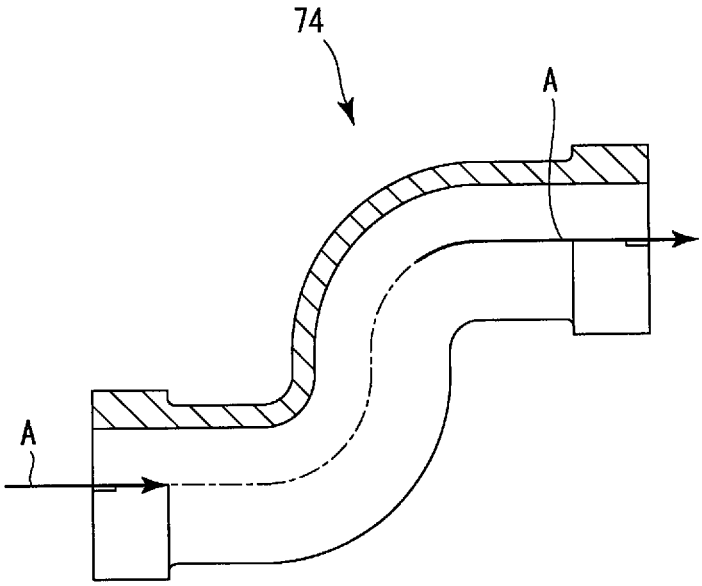
FIG. 13 is a plan view of an S-shaped pipe connecting between an air outlet of an air tank and an air discharge port of a housing.

The air tank body 44 has a peripheral wall 42 having a double-wall structure comprising, as shown in FIGS. 1, 10 and 11, an outer wall 42-1, an inner wall 42-2, and an air gap 42-3 provided between the outer and inner walls 42-1 and 42-2, thereby making it difficult for the vibration noise of air in the tank to be transmitted to the outside. In the illustrated example, a plurality of air gaps 42-3 are formed being spaced from each other in the circumferential direction of the peripheral wall 42. An intermediate wall 42-9 is formed between each pair of mutually adjacent air gaps 42-3 to connect together the outer and inner walls 42-1 and 42-2. In the air tank body 44, partition walls 42-4 are formed being suspended from the top wall 40 of the air tank body 44 to partition the interior space of the air tank body 44 into a plurality of spaces. Each partition wall 42-4 is provided with an air passage 42-5 extending upward from the bottom of the partition wall 42-4. Air introduced from air inlets 42-6 provided in the top wall 40 flows to an air outlet 42-10 through the air passages 42-5, thereby suppressing the pulsation of air discharged from the air outlet 42-10. The partition walls 42-4 and the inner wall 42-2 are shorter in length than the outer wall 42-1. The air outlet 42-9 is connected to an air discharge port 50-1 of the housing bottom part 50 through an S-shaped pipe 74 as shown in FIG. 13. The purpose of using the S-shaped pipe 74 is to absorb vibrations between the housing bottom part 50 and the air tank 20.

The peripheral wall 42 is provided with a plurality of screw-receiving holes 42-7 vertically extending therethrough. The bolts 47 inserted through the peripheral portion of the bottom wall member 46 are passed through the screw-receiving holes 42-7 and thread-engaged with the bottom portion of the casing 17, thereby clamping the air tank body 44 between the bottom wall member 46 and the bottom portion of the casing 17. The partition wall 42-4 in the center of the air tank body 44 is also provided with a screw-receiving hole 42-8. A bolt 49 inserted through the center of the bottom wall member 46 is passed through the screw-receiving hole 42-8, and the distal end of the bolt 49 is thread-engaged with a nut 49-1 fitted into the upper end of the screw-receiving hole 42-8, thereby securing the bottom wall member 46 to the tank body 44. The bottom wall member 46 has a sheet-shaped seal member 43 stacked on the upper surface thereof inside the outer wall 42-1 of the air tank body 44. The seal member 43 is made of a material more pliable than the resin used to form the air tank body 44. Thus, the inner wall 42-2 and partition walls 42-4 of the air tank body 44 sealingly clamp the seal member 43 between themselves and the bottom wall member 46. As shown in FIG. 11, ridges 42-2' and 42-4' capable of being forced into the seal member 43 are provided on the bottoms of the inner wall 42-2 and partition walls 42-4 of the air tank body 44 to extend along the respective walls.

Figure 12:
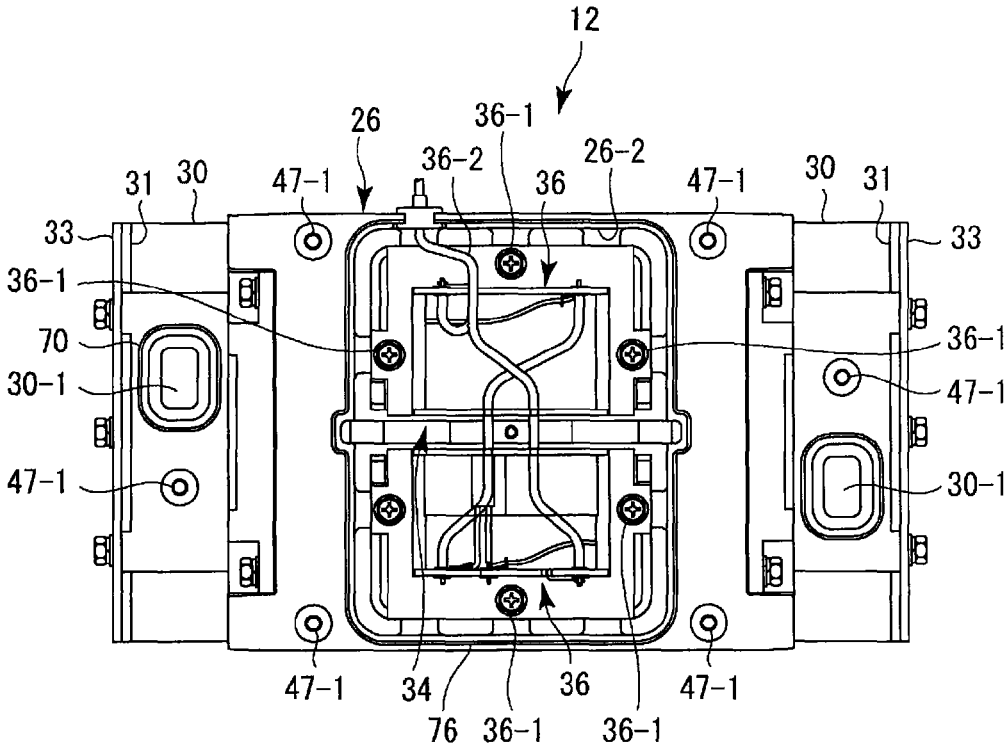
FIG. 12 is a bottom view of the pump unit.

FIG. 12 is a bottom view of the pump unit 12. Through the electromagnet-loading opening 26-2 of the casing body 26 are seen the armature 34 and the electromagnets 36 provided at the opposite sides of the armature 34, together with wiring 36-2 to the electromagnets 36. Threaded holes 47-1 are formed in the respective bottoms of the casing body 26 and the head covers 30. The distal (upper) ends of the bolts 47 are thread-engaged with the threaded holes 47-1, respectively, to secure the air tank body 44 as stated above The bottoms of the head covers 30 are further formed with air discharge openings 30-1, respectively, from which air discharged from the cylinder chambers 14 is discharged toward the air tank 20. The air discharge openings 30-1 are positioned to align with the air inlets 42-6 formed in the top wall 40 of the air tank body 44, which are shown in FIG. 10. Around the air discharge openings 30-1, annular ridges 70 are formed along the peripheral edges of the air discharge openings 30-1, respectively, so as to be forced into a sheet-shaped seal member 76 that is clamped between the air tank 20 and the bottom of the pump unit 12 when the former is secured to the latter, thereby sealingly engaging with the seal member 76. Around the electromagnet-loading opening 26-2, an annular ridge 76 is formed along the peripheral edge of the opening 26-2 so as to engage with the peripheral edge of an opening formed in the seal member 76 corresponding to the electromagnet-loading opening 26-2.

What is claimed is:

1. An air pump comprising:

a piston assembly of a pair of pistons and an armature disposed between the pair of pistons to connect the pair of pistons in a state that the pair of pistons are aligned with each other in an axial direction of the pistons;

a pair of electromagnets provided at opposite sides, respectively, of the armature in a direction perpendicular to the axial direction, wherein, when an alternating electric current is applied to the electromagnets, the electromagnets generate an alternating magnetic field traversing the armature to reciprocate the armature in the axial direction of the pistons; and a pump casing comprising a pair of cylinder chambers slidably accommodating the pair of pistons, respectively, and a drive chamber allowing the armature to move between the pair of cylinder chambers and accommodating the electromagnets; the pump casing comprising:

a casing body comprising side walls opposing each other in the axial direction, the side walls comprising circular cylindrical inner peripheral surfaces extending through the side walls and having axes aligned with each other, respectively to define the cylinder chambers, the circular cylindrical inner peripheral surfaces being slidable relative to the associated pistons, the casing body further comprising a cylindrical peripheral wall extending between the mutually opposing side walls to define the drive chamber, the casing body comprising an electromagnet-loading opening provided to extend through the peripheral wall from the drive chamber to an outside of the peripheral wall, wherein the piston assembly is configured to be inserted into the casing body in the axial direction through the circular cylindrical inner peripheral surface of one of the side walls with the piston assembly aligned with the aligned axes of the circular cylindrical inner peripheral surfaces and thereby the piston which is at a head of the piston assembly is received in the circular cylindrical inner peripheral surface of another one of the side walls and the piston which is at a tail of the piston assembly is received in the circular cylindrical inner peripheral surface of the one of the side walls;

at least one electromagnet pedestal member for positioning the pair of electromagnets at the opposite sides of the armature, the electromagnet pedestal member being inserted into the drive chamber through the electromagnet-loading opening and engaged with an inner peripheral surface of the peripheral wall, the electromagnet pedestal member engaging with the electromagnets inserted from the electromagnet-loading opening to position the electromagnets relative to the armature; and head covers attached to the casing body, after the piston assembly has been loaded thereinto, from left and right sides, respectively, of the casing body, the head covers defining the cylinder chambers, together with the circular cylindrical inner wall surfaces.

2. The air pump of claim 1, wherein the casing body comprises through-holes extending through the side walls, respectively, and cylindrical cylinder members fitted and secured to the through-holes, respectively, the cylinder members defining the circular cylindrical inner peripheral surfaces.

3. The air pump of claim 1, wherein the at least one electromagnet pedestal member comprises a pair of electromagnet pedestal members corresponding to the pair of electromagnets.

4. The air pump of claim 2, wherein the at least one electromagnet pedestal member comprises a pair of electromagnet pedestal members corresponding to the pair of electromagnets.

5. The air pump of claim 1, wherein the casing body further comprises: a plurality of suction ports extending from an outer peripheral surface to an inner peripheral surface of the casing body to suck air into the casing body from surroundings of the casing body, the air being to be supplied to the drive chamber;

an annular noise reduction wall annularly provided on the outer peripheral surface of the casing, the noise reduction wall having a radially inner surface annularly extending along the annular noise reduction wall and a radially outer surface annularly extending along the annular noise reduction wall; and, a lid member provided to close an opening defined by a top of the noise reduction wall, the lid member cooperating with the radially inner surface of the noise reduction wall and the outer peripheral surface of the casing to define a flat noise reduction chamber surrounded by the radially inner surface;

wherein the suction ports are positioned inside of and spaced apart from the radially inner surface of the annular noise reduction wall to fluidly communicate with the flat noise reduction chamber; and the noise reduction wall has at least one elongated noise reduction passage extending in the noise reduction wall in a circumferential direction of the noise reduction wall, one end of the noise reduction passage opening on the outer surface of the noise reduction wall, the other end of the noise reduction passage opening on the inner surface of the noise reduction wall so that the air is introduced from the surroundings into the flat noise reduction chamber through the at least one elongated noise reduction passage and then into the drive chamber through the suction ports.

* * * * *